US011819750B2

(12) United States Patent
Cornell

(10) Patent No.: US 11,819,750 B2
(45) Date of Patent: Nov. 21, 2023

(54) SYSTEM AND PROCESS FOR INSTALLING BASKETBALL GOALS

(71) Applicant: Indian Industries, Inc., Evansville, IN (US)

(72) Inventor: Robert W. Cornell, Evansville, IN (US)

(73) Assignee: Indian Industries, Inc., Evansville, IN (US)

( * ) Notice: Subject to any disclaimer, the term of this patent is extended or adjusted under 35 U.S.C. 154(b) by 19 days.

(21) Appl. No.: 17/247,979

(22) Filed: Jan. 4, 2021

(65) Prior Publication Data

US 2021/0236908 A1 Aug. 5, 2021

Related U.S. Application Data

(60) Provisional application No. 62/969,201, filed on Feb. 3, 2020.

(51) Int. Cl.
*A63B 71/02* (2006.01)
*A63B 63/08* (2006.01)
(Continued)

(52) U.S. Cl.
CPC ..... *A63B 71/023* (2013.01); *A63B 63/083* (2013.01); *E02D 5/801* (2013.01);
(Continued)

(58) Field of Classification Search
CPC ..... A63B 63/083; A63B 71/023; A63B 2063/086; A63B 69/0071;
(Continued)

(56) References Cited

U.S. PATENT DOCUMENTS 1,323,067 A * 11/1919 Keith ..... E04B 1/4164 52/704
1,699,557 A * 1/1929 Yeager ..... E04B 5/12 52/370
(Continued)

FOREIGN PATENT DOCUMENTS

CN 102733640 A 10/2012
CN 206488246 U 9/2017
(Continued)

OTHER PUBLICATIONS

Chinese Office Action issued in Application No. 202210994640.3, dated Oct. 9, 2022, 7 pgs.

*Primary Examiner* — Melba Bumgarner
*Assistant Examiner* — Amir A Klayman
(74) *Attorney, Agent, or Firm* — Woodard, Emhardt, Henry, Reeves & Wagner, LLP

(57) ABSTRACT

A system and process for installing in-ground base and basketball systems allows the systems to be installed without needing to wait for concrete to cure. During installation, concrete is poured and anchor bolts are positioned in the wet concrete, a brace is placed over the upper face of the concrete base and the protruding anchor bolt ends. The brace includes a plurality of outwardly extending lateral legs. The legs extend horizontally beyond the edges of the concrete base and into/over the adjacent ground. A stake is placed through each leg. The basketball goal system is then mounted to the anchor bolts and brace. The brace assists in holding the basketball goal system in the correct position while the concrete cures.

9 Claims, 8 Drawing Sheets

(51) Int. Cl.
*E02D 5/80* (2006.01)
*E02D 27/42* (2006.01)

(52) U.S. Cl.
CPC ..... *E02D 5/808* (2013.01); *E02D 27/42* (2013.01); *A63B 2071/024* (2013.01); *E02D 2250/0023* (2013.01); *E02D 2300/002* (2013.01); *E02D 2600/30* (2013.01); *E02D 2600/40* (2013.01)

(58) Field of Classification Search
CPC . A63B 2071/024; A63B 63/08; A63B 71/028; A63B 21/16; E02D 5/801; E02D 5/808; E02D 27/42; E02D 2250/0023; E02D 2300/002; E02D 2600/30; E02D 2600/40
See application file for complete search history.

(56) References Cited

U.S. PATENT DOCUMENTS 3,544,110 A * 12/1970 Dickinson ..... A63B 71/023 473/483
3,923,302 A * 12/1975 Boggild ..... A63B 9/00 482/33
3,963,210 A * 6/1976 Macklin ..... E04G 21/185 249/91
4,000,591 A * 1/1977 Courtois ..... E04G 21/142 52/707
4,079,559 A * 3/1978 Tenbrummeler ..... E02D 27/42 248/534
4,083,161 A * 4/1978 Moen ..... E04B 1/4157 249/213
4,096,677 A * 6/1978 Gilb ..... E02D 27/42 52/297
4,099,354 A * 7/1978 DePirro ..... E02D 27/42 52/165
4,295,317 A * 10/1981 VanTielen ..... E04H 12/10 52/651.08
4,412,407 A * 11/1983 Melfi ..... E04G 21/185 52/309.1
4,714,225 A 12/1987 Skinner et al.
4,872,298 A * 10/1989 Klemic, Jr. ..... E04B 1/4157 52/707
4,924,648 A * 5/1990 Gilb ..... E04H 12/2253 52/297
4,995,206 A * 2/1991 Colonias ..... E04H 12/2253 52/480
5,060,436 A * 10/1991 Delgado, Jr. ..... B28B 23/005 52/699
5,442,887 A * 8/1995 Welsh ..... E04B 7/045 52/93.2
5,505,033 A * 4/1996 Matsuo ..... E02D 27/42 52/169.9
5,571,229 A 11/1996 Fitzsimons et al.
5,740,645 A * 4/1998 Raby ..... E02D 27/42 52/297
5,913,778 A 6/1999 Hying et al.
6,419,596 B1 7/2002 Dadbeh
6,588,169 B2 * 7/2003 Sarver ..... E04B 1/41 24/17 AP
6,776,734 B2 8/2004 van Nimwegen
6,783,472 B1 8/2004 Standford et al.
6,868,641 B2 * 3/2005 Conner ..... E01F 9/635 52/165
6,871,455 B1 * 3/2005 Cockman ..... E02D 5/801 52/165
6,929,571 B2 8/2005 Jesch et al.
7,219,873 B2 * 5/2007 Harwood ..... E04H 12/2261 181/171
7,240,743 B2 * 7/2007 Buss ..... G01N 33/24 175/58
7,357,738 B2 4/2008 White et al.
7,462,117 B2 12/2008 White et al.
7,721,490 B1 * 5/2010 Cerula ..... E04H 12/2253 52/855
7,721,494 B2 * 5/2010 Lee ..... E02D 27/00 52/742.16
7,766,299 B2 * 8/2010 Titus, II ..... G09F 15/0025 52/157
7,823,348 B1 * 11/2010 Leiva ..... E02D 27/42 52/297
7,984,541 B1 * 7/2011 Davidson ..... B25B 23/00 33/645
7,987,636 B2 * 8/2011 Hunt ..... E04B 7/045 52/93.2
8,136,260 B1 * 3/2012 Jones ..... G01B 5/24 33/562
8,397,464 B2 * 3/2013 Lin ..... E04B 1/4157 52/701
8,845,151 B1 9/2014 Hale
9,068,347 B2 * 6/2015 Moeller ..... E04B 2/90
9,222,251 B2 * 12/2015 Espinosa ..... E04B 1/4171
9,284,744 B2 * 3/2016 Patterson ..... E04H 12/2261
9,602,452 B2 * 3/2017 Gerstl ..... H04L 51/42
9,850,676 B2 * 12/2017 Hamilton ..... E04H 12/2261
10,000,904 B2 6/2018 Hurley
10,077,893 B1 9/2018 Abraham
10,577,816 B1 * 3/2020 Espinosa ..... E04B 1/4157
2006/0016140 A1 * 1/2006 Smith ..... E02D 27/02 52/295
2006/0194654 A1 8/2006 Winter et al.
2010/0205875 A1 * 8/2010 Rawson-Harris ... G09F 15/0037 52/849
2011/0041450 A1 * 2/2011 Espinosa ..... E04C 5/12 52/698
2013/0061555 A1 * 3/2013 Knudsen ..... E04H 12/22 52/834
2013/0207305 A1 * 8/2013 Moore ..... E04H 12/22 264/262
2013/0212958 A1 * 8/2013 Knudsen ..... E02D 5/26 52/173.1
2014/0311083 A1 * 10/2014 Madril ..... E04H 17/22 248/351
2017/0044790 A1 * 2/2017 Knudsen ..... E04B 1/92
2021/0123258 A1 * 4/2021 Elpers ..... E04H 12/2261

FOREIGN PATENT DOCUMENTS

CN 107923136 A * 4/2018 ..... E02D 27/42
CN 108193669 A * 6/2018
CN 207555392 U 6/2018
CN 208186206 U 12/2018
KR 200475902 Y1 * 1/2015
WO WO-2016203066 A1 * 12/2016

* cited by examiner

SYSTEM AND PROCESS FOR INSTALLING BASKETBALL GOALS

The present application claims the benefit of application No. 62/969,201 filed on Feb. 3, 2020 and which is incorporated by reference.

FIELD OF THE DISCLOSURE

The present disclosure deals with basketball goal assemblies and particularly installing in-ground bases and basketball goal assemblies.

BACKGROUND

Basketball is a popular sport that can be played by anyone who has access to a ball and a basketball goal. Basketball goal systems have become common to find by driveways and in public parks. Many such goals are considered "in-ground" basketball goals, meaning they are permanently installed, either by the goal post extending into the ground or with the lower end of the goal secured to a base, such as a block of concrete, buried in the ground.

The present disclosure deals with installing in-ground basketball goals using a concrete base, typically adjacent a basketball court or a playing surface such as a driveway or a concrete pad. Currently it is a two-trip process on two different days for installers to install an in-ground basketball goal system. Typically, during the first visit a hole is dug in the ground for the base of the basketball goal system. The hole is then filled with liquid concrete. During the filling process, rebar sections are placed in the wet concrete. Additionally, L-shaped anchor bolts are embedded in the concrete with their upper ends protruding. The bolts must be properly positioned in height and aligned relative to the playing surface to support and properly align the goal post. The upper face of the concrete is ideally flat and level. The concrete must then be allowed to cure, which often requires at least a 72 hour wait. Once the concrete has cured, the installer makes a second visit to assemble and install the basketball goal system on the base.

SUMMARY

The present disclosure illustrates a system and process which allows installers to setup an in-ground base and basketball goal system in a single visit, without needing to wait for the concrete to cure. A representative method for installing an in-ground base and basketball system, comprises pouring wet concrete into a base hole in the ground and embedding a series of anchor bolts in the wet concrete with upper ends of the anchor bolts protruding from an upper face of the concrete. The method includes orienting a brace over the upper face of the concrete base and the protruding anchor bolt ends so that the anchor bolt ends extend through openings defined in the brace. The brace includes a plurality of legs which extend laterally outward, with each leg having a length extending to a distal end beyond the concrete. The method includes securing the brace to the anchor bolts, securing the distal end of each leg to the ground, and then vertically mounting a support member to the anchor bolts in the wet concrete. The support member includes a basketball backboard and a rim assembly adjacent its upper end.

An alternate embodiment of an in-ground base and basketball system comprises a concrete base arranged in the ground with a series of anchor bolts embedded in the base. Upper ends of the anchor bolts protrude from an upper face of the base. A brace is oriented over the upper face of the base and the protruding anchor bolt ends, wherein the anchor bolts extend through openings defined in the brace. A series of three legs are spaced around the brace and extend radially from the brace, each leg having a length sufficient to extend to a distal end beyond the concrete. A ground engagement element secures each distal end to the ground. A support member is vertically mounted to the anchor bolts. A basketball backboard and a rim assembly are mounted adjacent an upper end of the support member.

In certain embodiments, once the concrete has been poured and the anchor bolts are positioned in the wet concrete, a brace is placed over the upper face of the concrete base and the protruding anchor bolt ends. The brace has bolt hole openings which function as a template or jig to properly align the protruding anchor bolts. The brace further includes a plurality of outwardly extending lateral legs. The legs have sufficient length to extend horizontally beyond the edges of the concrete base and into/over the adjacent ground surface. A ground engaging stake is placed through each lateral leg, with each stake penetrating into and engaging the adjacent ground material. Once the brace is installed and the ground engaging stakes are emplaced, the basketball goal system is mounted to the base via the protruding bolts. The brace assists in holding the basketball goal system in a level and correct position relative to the base while the concrete cures. Once the concrete is cured, the concrete base provides the primary support for the basketball system. The brace is no longer needed but remains in place.

Further objects, features and advantages of the present disclosure shall become apparent from the detailed drawings and descriptions provided herein.

DESCRIPTION OF DISCLOSED EMBODIMENTS

Figure 1:
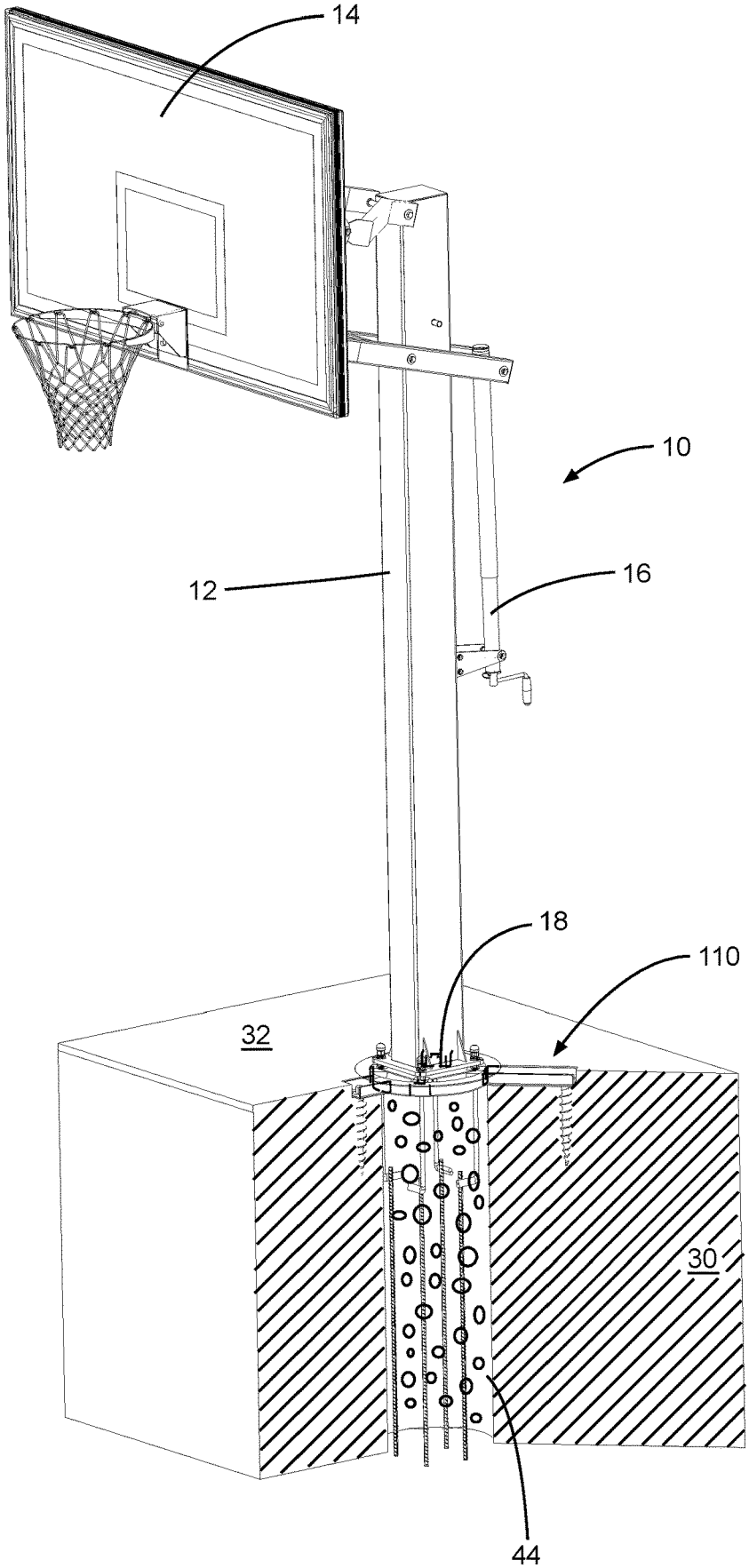
FIG. 1 is a perspective view of a basketball goal system incorporating an embodiment of the present disclosure.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein being contemplated as would normally occur to one skilled in the art to which the disclosure relates.

The present disclosure illustrates a system and process which allows installers to install an in-ground base and a basketball system in a single visit, without needing to wait for the concrete to cure. Once the concrete has been poured and the anchor bolts are positioned in the concrete, a brace is placed over the upper face of the concrete base and the protruding anchor bolt ends. The brace has bolt hole openings which function as a template or jig to properly align the protruding anchor bolts. In the illustrated embodiment, the brace is based on a ring shape, with four inwardly extending tabs or flanges. Bolt hole openings are positioned and defined by the tabs. Alternate brace shapes or bolt hole positioners can be used.

The brace further includes a plurality of outwardly extending lateral legs. The legs have sufficient length to extend horizontally beyond the edges of the concrete base and into/over the adjacent ground surface. The legs each define a stake hole at the outward end. A ground engaging stake is placed through each lateral leg, with each stake penetrating into and engaging the adjacent ground material. In the illustrated embodiment, ground screws are used as the stakes. The stakes then hold the brace in the proper position over the concrete base and concurrently hold the protruding anchor bolt ends in position.

Once the brace is installed over the base and the ground engaging stakes are emplaced, the basketball goal system can be placed in position over the brace and mounted to the base via the protruding bolts. In certain preferred embodiments, the brace and basketball system are installed while the concrete is wet. The brace assists in holding the basketball goal system in a level and correct position relative to the base while the concrete cures. Alternately, yet less preferred, the brace could be used in combination with a pre-prepared base. Once the concrete is cured, the base provides the primary support for the basketball system. The brace is no longer needed but remains in place.

A representative method for installing an in-ground base and basketball system comprises pouring wet concrete into a base hole in the ground and embedding a series of anchor bolts in the wet concrete with upper ends of the anchor bolts protruding from an upper face of the concrete. The method includes orienting a brace over the upper face of the concrete base and the protruding anchor bolt ends so that the anchor bolt ends extend through openings defined in the brace. The brace includes a plurality of legs which extend laterally outward, with each leg having a length extending to a distal end beyond the concrete. The method includes securing the brace to the anchor bolts, securing the distal end of each leg to the ground, and then vertically mounting a support member to the anchor bolts in the wet concrete. The support member includes a basketball backboard and a rim assembly adjacent its upper end.

FIG. 1 representatively illustrates a basketball goal system 10 as well as installation kit 110. Basketball goal system 10 includes a backboard assembly 14 with a rim assembly and a backboard panel. Various backboard assemblies, backboards, and rim assemblies, and variations thereon can be used as desired. The backboard assembly 14 is mounted adjacent an upper end of a support member such as support pole 12. The backboard assembly 14 may be laterally offset from the support pole, for instance using one or more support arms. Optionally the height of backboard assembly 14 is adjustable, for example using pairs of arms which form a parallelogram which can be adjusted using a mechanism such as a piston 16. In some embodiments, support pole 12 may be monolithic; however, in other embodiments support pole 12 may include two or more portions connected together. Support pole 12 may have a curved cross-section such as a circular or oval shape, or a rectangular cross-section, or it may have a cross-section of any other desired shape.

The lower end 18 of support pole 12 is configured to be mounted to a base. Lower end 18 may include a horizontal plate with a cross-section that extends beyond pole 12 or horizontal flanges extending outward around the perimeter. Mounting holes may be defined in the horizontal portions of lower end 18. In some embodiments support pole 12 is vertically installed and extends perpendicular to the support surface 32. In alternate, embodiments, support pole 12 may be vertical yet angled so that pole 12 extends obliquely from the base relative to the support surface 32.

Figure 2:
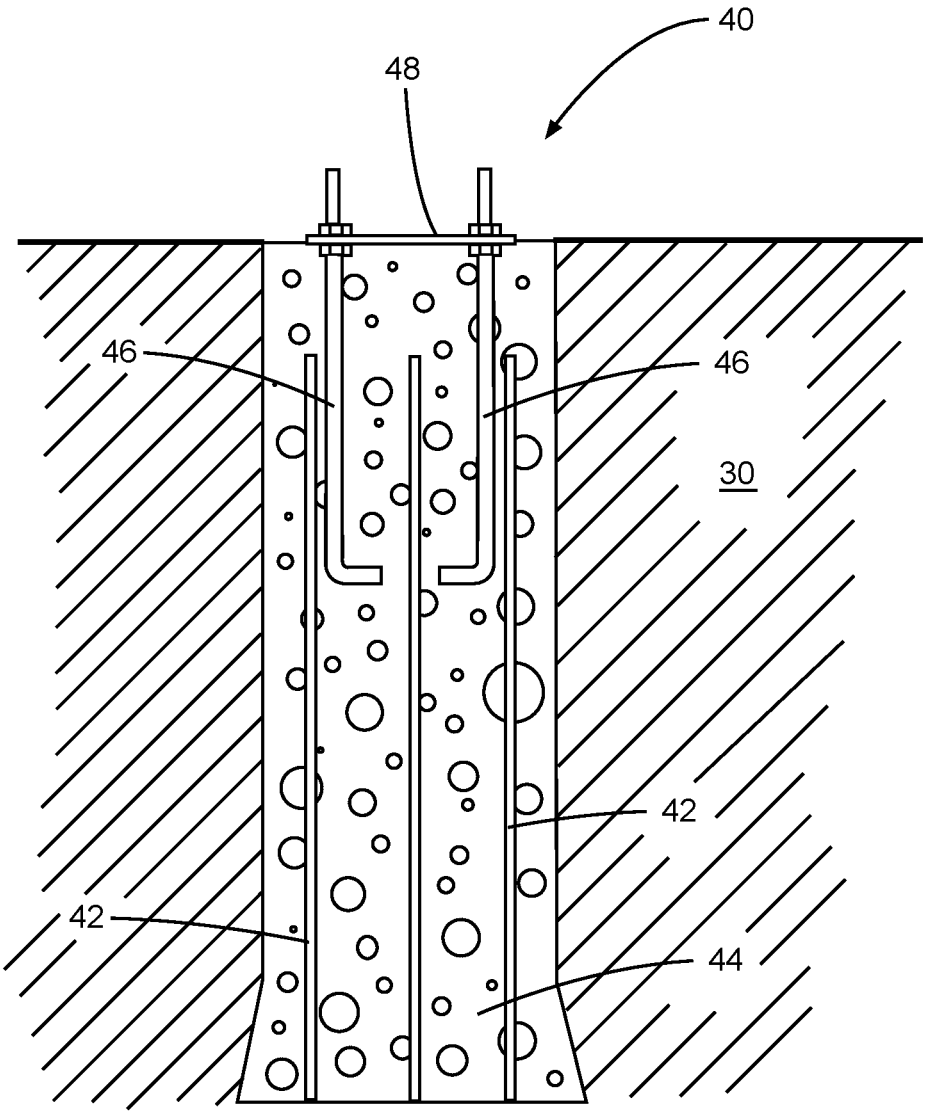
Fig. 2 Prior Art
FIG. 2 is aside view of a typical prior art base arrangement.

A prior art base 40 is illustrated in FIG. 2. As illustrated in FIG. 2, a hole, for instance approximately 48" deep and 16" in diameter, is dug in the material of ground 30. Liquid/wet concrete 44 is then poured into the hole. During the filling process, rebar sections 42 may be placed in the wet concrete for reinforcement. L-shaped anchor bolts 46 are also embedded in the wet concrete with their upper ends protruding above the upper face of the concrete 44. The bolts 46 are positioned in height and aligned in both side-to-side and front-to-rear spacing relative to the playing surface and each other to support and properly align the goal post and backboard assembly. The upper face of the concrete 44 is ideally flat and level. A template 48 with holes for anchor bolts 46 may be placed over the upper face of the concrete 44. The template holes may be configured to match corresponding holes defined in the lower end 18 of support pole 12. The template 48 may assist in ensuring a flat horizontal upper face as well as proper alignment of the anchor bolts. Threaded bearings/bushings may be mounted below template 48 to assist in leveling it.

Figure 3:
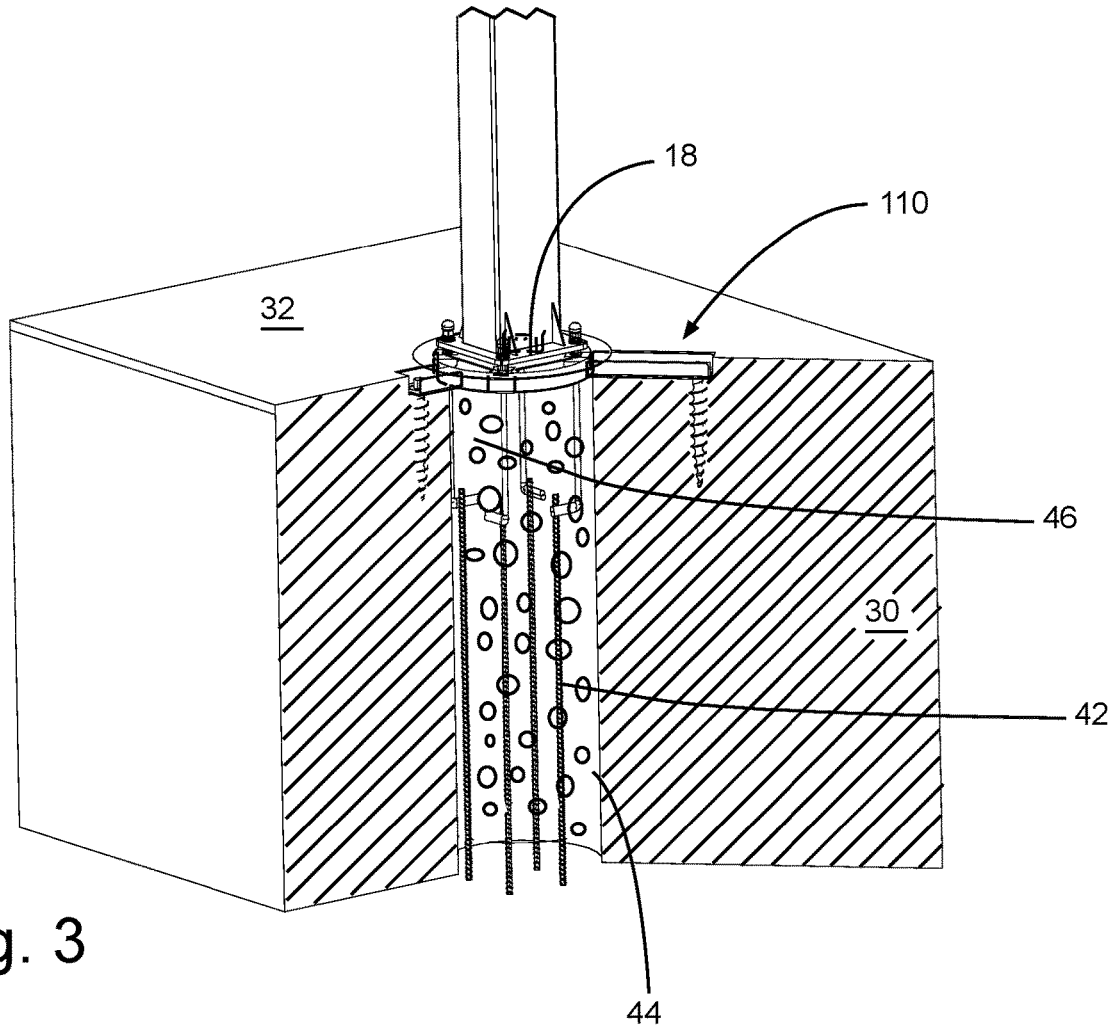
FIG. 3 is a perspective, cross-sectional view of the lower portion of the basketball goal system of FIG. 1 including the brace and ground engaging stakes.
Figure 4:
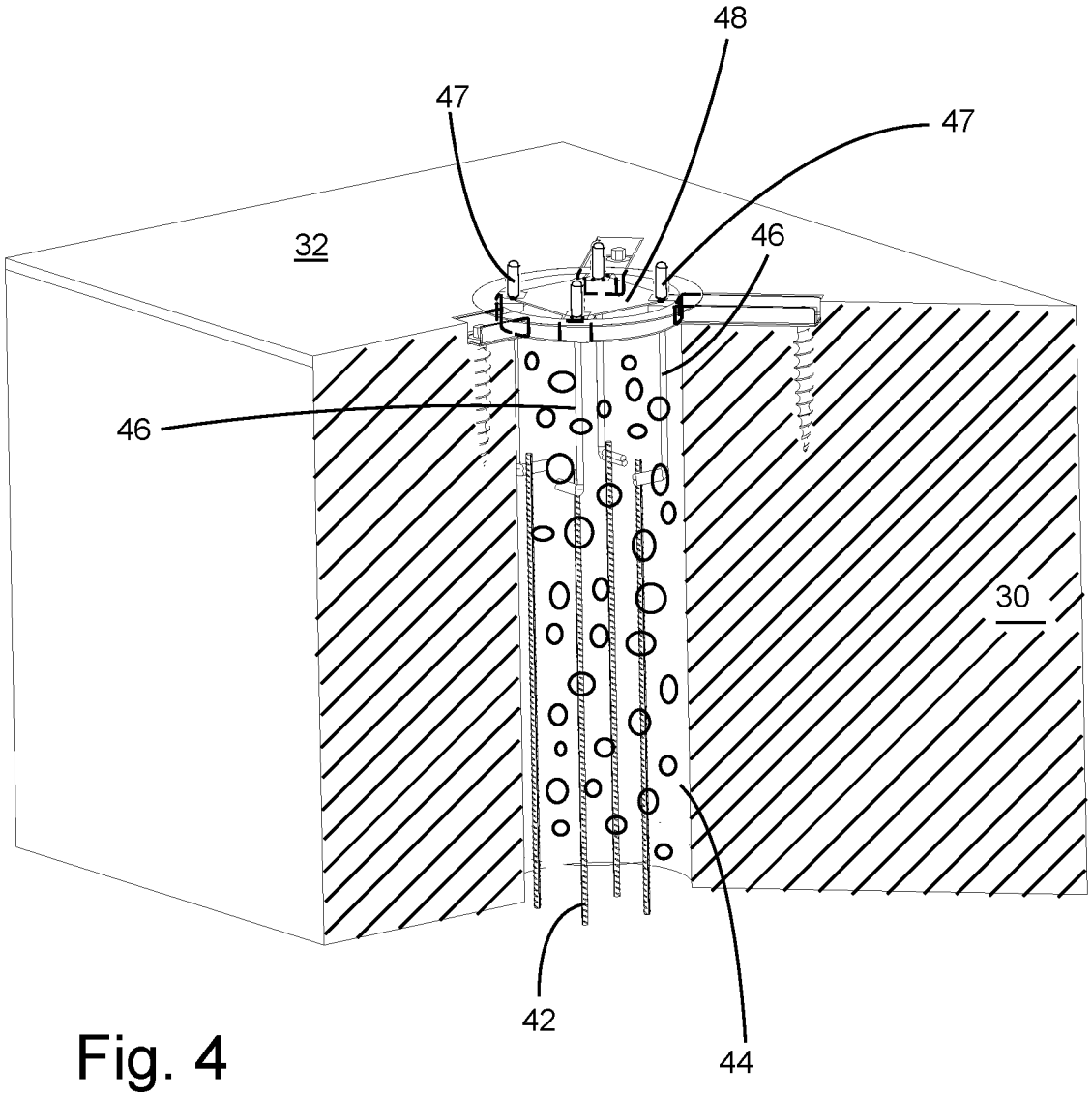
FIG. 4 is a perspective, cross-sectional view of the brace and ground engaging stakes without the basketball goal system.
Figure 5:
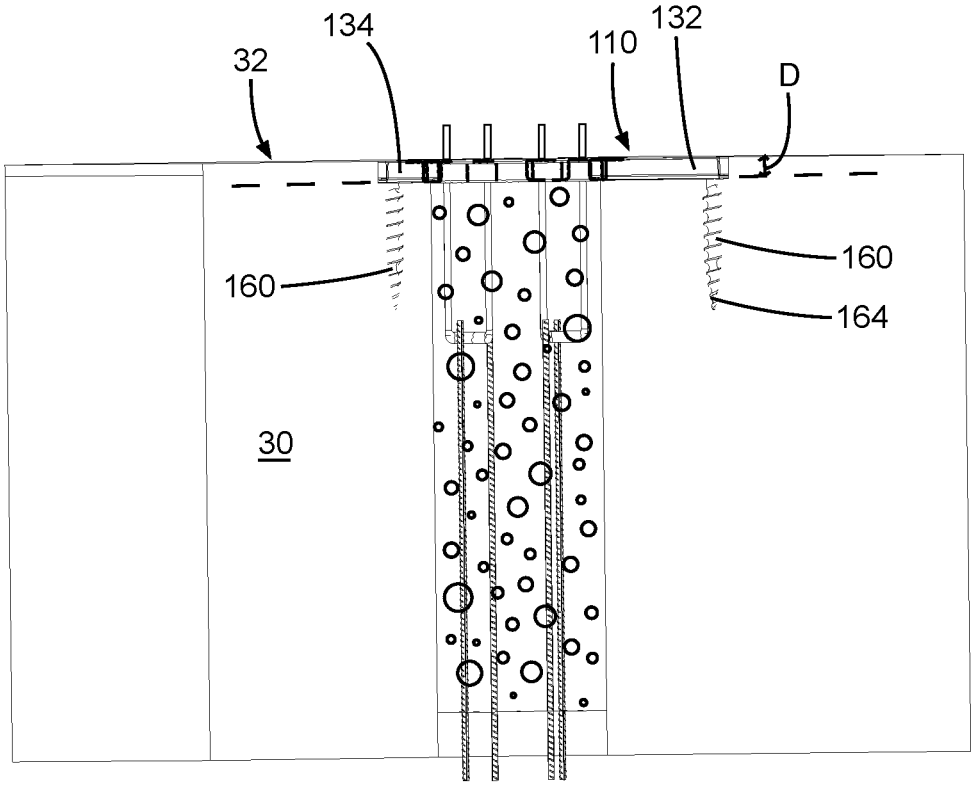
FIG. 5 is a side view of the brace and ground engaging stakes without the basketball goal system.
Figure 6:
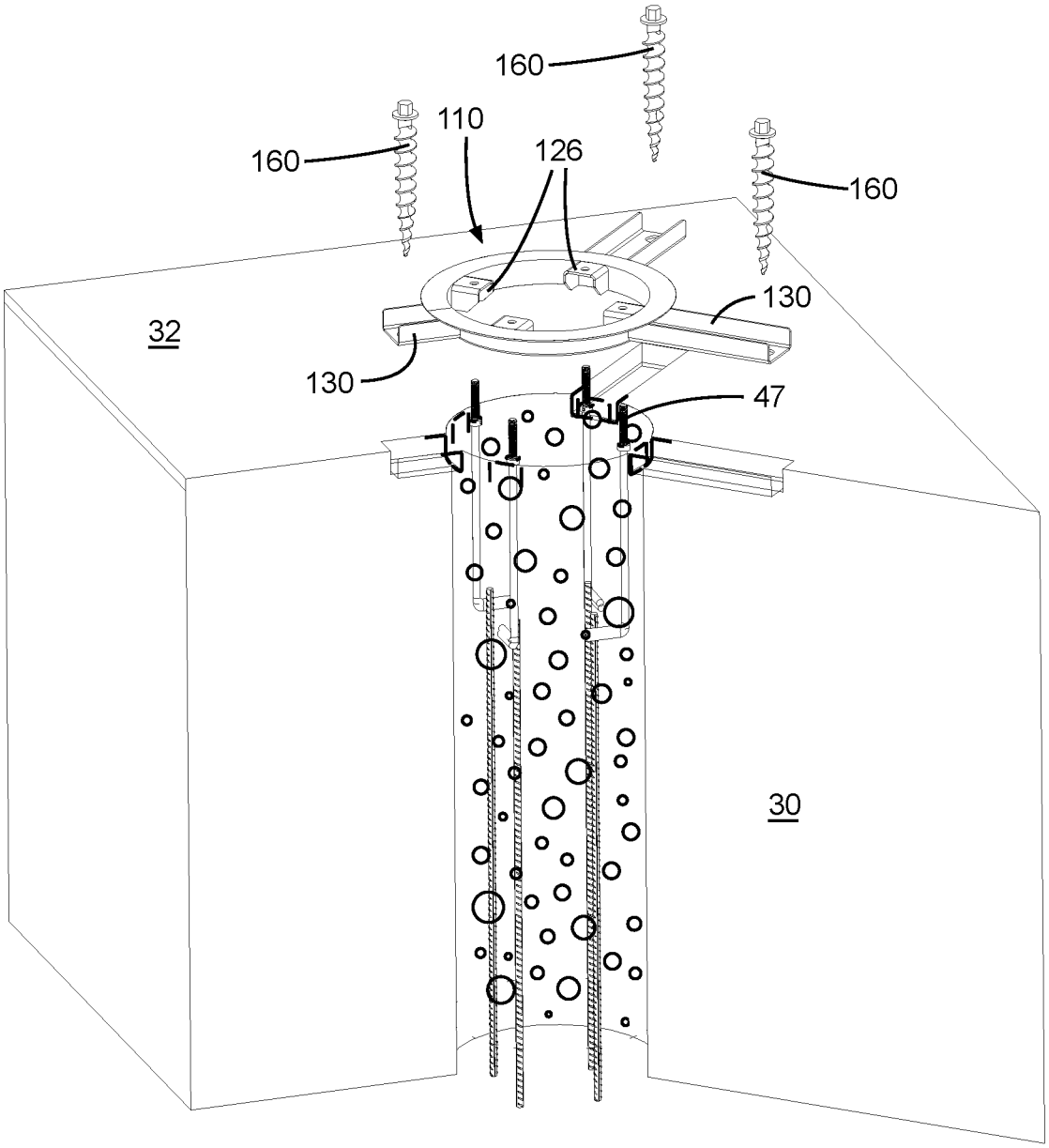
FIG. 6 is a perspective exploded view of the brace and ground engaging stakes.

FIGS. 3-6 provide views of base arrangement 40 with installation kit 110. The lower end 18 of the support pole is shown in FIG. 3, but removed in FIGS. 4-6 for ease of illustration. Base arrangement 40 again starts with a deep central hole with appropriate dimensions dug in the ground 30. Additionally, a series of shallow leg areas matching the height and length of the lateral legs are dug, extending radially from the center hole. Rebar sections 42 and wet concrete 44 are placed in the lower portion of the hole. L-shaped anchor bolts 46, in this embodiment four bolts, are embedded in the concrete with their upper ends 47 protruding above the concrete. Brace 120 is then placed over the protruding upper ends 47 of the four anchor bolts 46. Optionally, threaded bearings may be mounted and leveled on protruding ends 47 to assist in leveling brace 120. Brace 120 may be placed against and/or embedded slightly in the upper face of the concrete 44. The upper surface of brace 120 is preferably flush with or slightly below the surface 32 of ground 30. Brace 120 further includes lateral legs 130 which are received and nested within the shallow leg areas. The upper edges/surfaces of legs 130 are preferably flush with or slightly below the surface 32 of ground 30. Lateral legs 130 extend horizontally beyond the perimeter of the center hole and past the outer edges of concrete 44. Ground engaging stakes 160 are used to secure the distal end of each lateral leg 132 to ground 30. After installation of base 40 and brace 120, the lower end 18 of support pole 12 may be secured to the protruding ends 47 of anchor bolts 46.

Figure 7A:
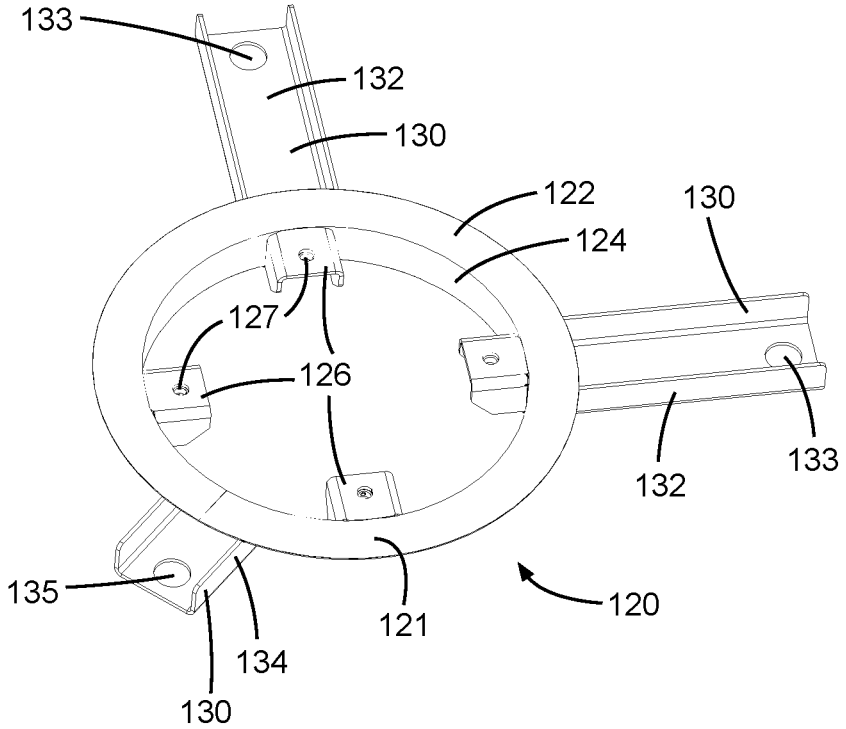
FIG. 7A is a perspective upper view of the brace.
Figure 7B:
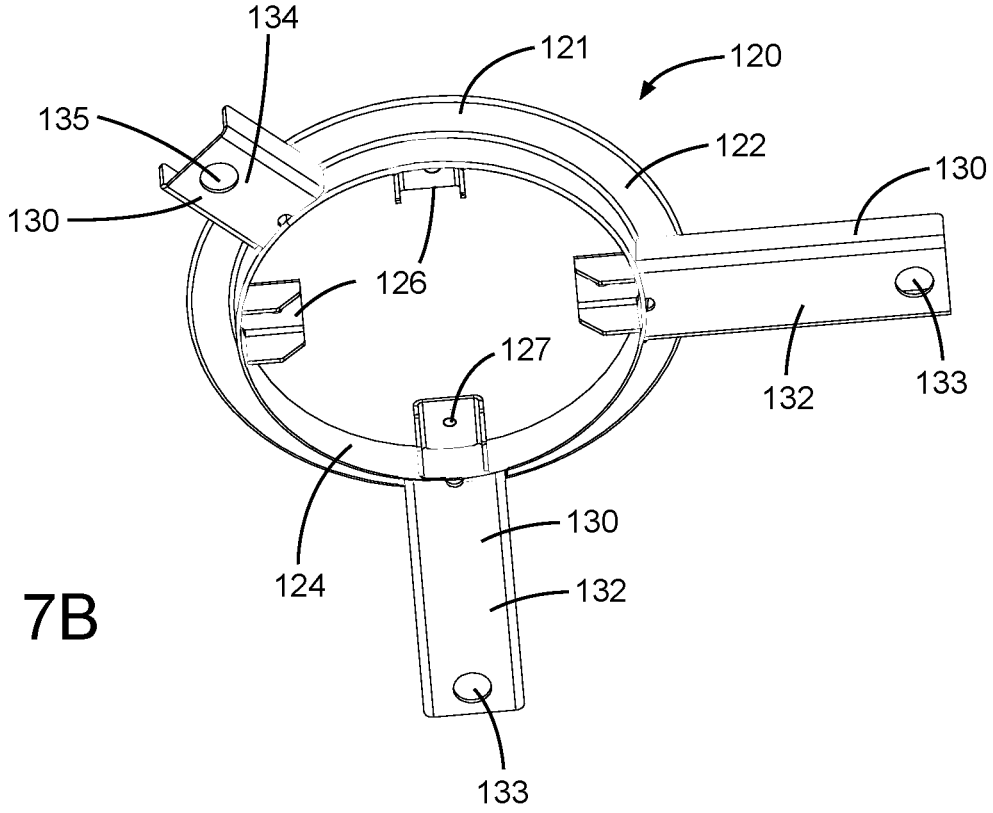
FIG. 7B is a perspective lower view of the brace of FIG. 7A.

Brace 120 is shown in greater detail in FIGS. 7A and 7B. Brace 120 includes a base or bracket piece 121. In the illustrated embodiment, base 121 is ring shaped, although other shapes can be used as desired. Base 121 has an L-shaped cross-section including a flat upper flange 122 with an upper surface defining the upper surface of brace 120. The cross-section also includes a downward extending flange 124 defining substantially vertical, inward and outward facing ring-shaped surfaces.

A plurality of tab portions 126 extend radially inward from the inward facing surface of flange 124. The tab portions 126 are secured to base 121 via welding, using fasteners or otherwise as desired. Alternately, the tab portions could be integrally formed with base 121. The number of tab portions 126 corresponds to the number of anchor bolts 46. In the illustrated embodiment there are four tab portions. In certain embodiments, tab portions 126 each have downward-opening U-shaped profile, with a flat upper surface between a pair of side edges extending downward. Tab portions 126 each define a vertical bolt opening 127 in their upper surface. Tab portions 126 are spaced so that when brace 120 is placed over bolts 46, the protruding bolt ends 47 are aligned to extend though vertical bolt openings 127, and correspondingly are precisely aligned to mate with mounting holes defined in lower end 18 of support pole 12.

Additionally, brace 120 includes a plurality of radially extending lateral legs 130. In the illustrated embodiment, there are a pair of longer lateral legs 132 and a third lateral leg 134 which is optionally shorter. More lateral legs may be used if desired. Optionally yet preferably, lateral legs 130 extend radially outward and are evenly spaced about the perimeter of base 121. The lateral legs 130 are secured to the outward facing surface of the downward extending flange 124 and/or to the under side of upper flange 122 via welding, using fasteners or otherwise as desired. Alternately the lateral legs may be integrally formed with base 121. In the illustrated embodiment, there are three lateral legs 130 spaced at approximately 120 degree intervals around base 121. In certain embodiments, lateral legs 130 each have an upward-opening U-shaped profile, with a flat lower surface between a pair of side edges extending upward. Lateral legs 130 each define a stake opening 133 or 135 in their lower surface.

Optionally, lateral leg 134 is shorter than lateral legs 132. During installation of brace 120, lateral leg 134 is oriented toward the adjacent basketball court or playing surface. The shorter length of lateral leg 134 enables brace 120 to be placed more closely adjacent the basketball playing surface than if a longer lateral leg extended toward the playing surface. Lateral legs 130 each have a length sufficient to extend from base 121 to a distal end spaced beyond the concrete 44 forming the base. Each lateral leg 130 extends a sufficient distance so that the corresponding stake opening is vertically arranged over the surrounding ground material and spatially separated outward from concrete 44. In some embodiments, the legs are inset in the ground, so that the stake openings may be slightly below the ground surface yet still vertically arranged over the surrounding ground material.

In certain embodiments, ground engaging stakes 160 are helically threaded tapered ground screws sized in diameter so that the shaft and thread portions 164 may pass through stake openings 133 or 135, with a cap or head portion 162 having a larger diameter which will not fit through the stake opening. During installation, each ground stake is driven through a corresponding stake opening and into ground 30. When fully advanced, the shaft and thread portion 164 engages the surrounding material of the ground, while the cap or head portion 162 abuts the corresponding lateral leg and secures it against ground 30. The cap or head portion 162 may be received within the U-shaped profile of the lateral leg 130, allowing the cap or head portion 164 to be driven flush with or below the ground surface 32. In alternate embodiments, other forms of ground engaging stakes, such as vertical or angled spikes with smooth or splined surfaces, may be used.

Figure 8:
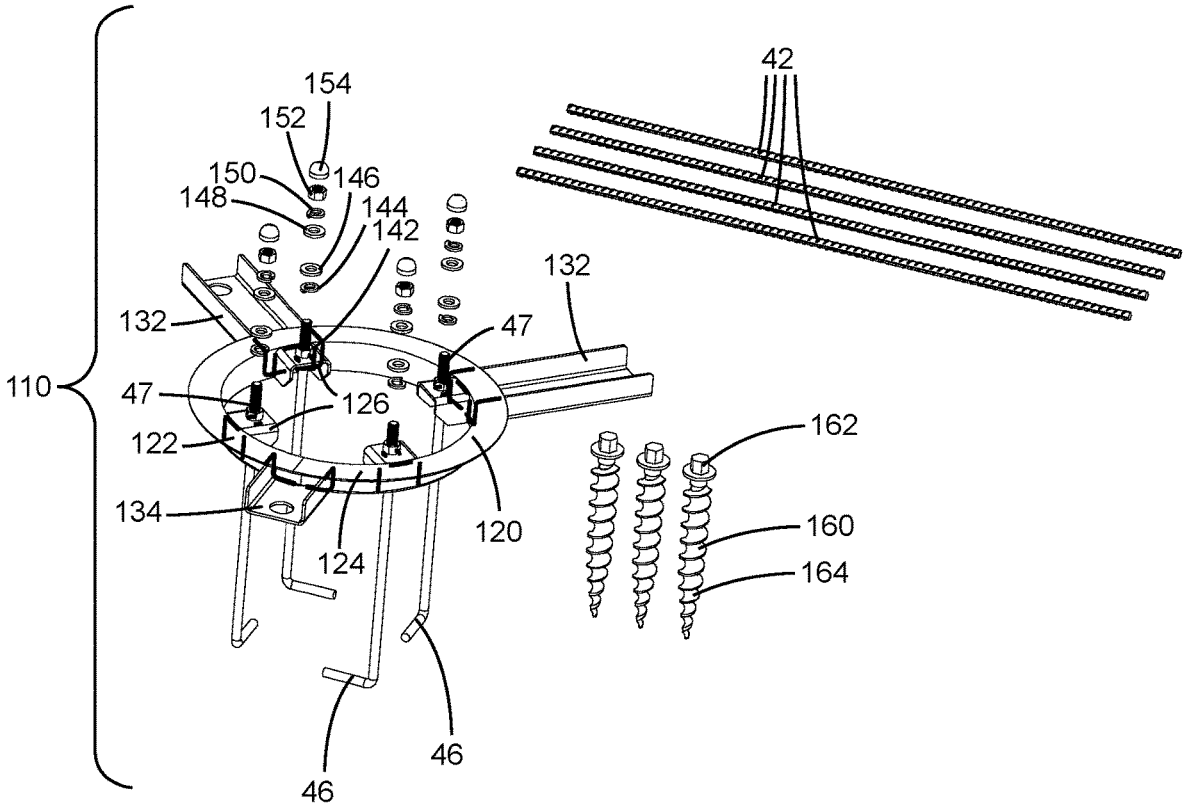
FIG. 8 is an exploded view of an installation kit including the brace and ground engaging stakes.

FIG. 8 illustrates the hardware component parts of installation kit 110. Installation kit 110 includes rebar pieces 42, bolts 46, brace 120 and a set of ground stakes 162, as well as a corresponding plurality of bearings, washers and nuts.

As a representative installation method, the installer prepares a base hole with appropriate dimensions in the ground 30 and may optionally also prepare appropriate shallow leg areas. Wet concrete is poured into the base hole, and rebar sections 42 may be emplaced in the lower portion of the hole. Anchor bolts 46 are embedded in the wet concrete with their upper ends 47 protruding from an upper face of the concrete. Optionally, threaded bearings may be placed and aligned on the bolts to assist in providing a level support plane. Brace 120 is then oriented, placed and leveled over the protruding upper ends 47 of the four anchor bolts 46, over the threaded bearing if present, and, when used, with lateral legs 130 arranged in the optional shallow leg areas. Brace 120 is then secured to bolts 46, for instance with a lower nut 142 threadably engaged with a protruding end 47 and advanced to abut a corresponding tab 126. Optionally, the relative heights of lower nuts 142 may be adjusted and aligned so that the four nuts define a level support plane for the basketball goal system. Next, the distal end of each leg member is secured to the ground, for instance by driving ground engaging stakes 160 through the lateral legs 130 and into ground 30. The basketball goal system 10 is then able to be immediately mounted on the base and brace 120, without needing to wait for the concrete to fully cure.

In more detail, one or more lower flat washers 144 and lower lock washers 146 may be placed on protruding bolts ends 47 over corresponding lower nuts 142. The number of lower washers may be varied to assist in providing a level support surface. The basketball goal system 10 may then be placed over brace 120 and the base, with protruding bolts ends 47 extending through corresponding openings defined in the horizontal portions of lower end 18. Thereafter, a series of upper flat washers 148, upper lock washers 150 and upper nuts 152 are placed on protruding bolts ends 47 and advanced downward to sandwich and secure lower end 18 in place. Optionally, cap nuts 154 may be used to cover the upper ends of bolts 146.

While the concrete cures, brace 120 assists in holding the basketball goal system in the proper position. After the concrete cures, brace 120 may remain in place. While not necessary, brace 120 may provide additional stability assistance. Optionally, brace 120 and lateral legs 130 may be covered, for example with soil and grass.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed is:

1. A method for installing an in-ground base and basketball system, comprising:

a. pouring wet concrete into a base hole in the ground;

b. embedding a series of anchor bolts in the wet concrete with upper ends of the anchor bolts protruding from an upper face of the wet concrete;

c. orienting a brace over the upper face of the wet concrete and the protruding anchor bolt ends, wherein the upper ends of the anchor bolt extend through openings defined in the brace, and wherein the brace includes a plurality of legs which extend laterally outward, with each leg having a length with a distal end extending beyond the wet concrete;

d. securing the brace to the anchor bolts;

e. securing each distal end to the ground; and, f. vertically mounting a support member to the anchor bolts in the wet concrete, the support member including a basketball backboard and a rim assembly adjacent an upper end.

2. The method of claim 1, wherein the brace comprises a ring shaped base and wherein the anchor bolt ends extend through openings defined in the base.

3. The method of claim 2, wherein the plurality of legs comprises a series of three legs radially spaced around the ring shaped base.

4. The method of claim 3, wherein one leg has a shorter length than the other two.

5. The method of claim 1, wherein the distal ends of the legs are secured to the ground with ground engaging stakes.

6. The method of claim 5, wherein the stakes are helically threaded ground screws.

7. The method of claim 1, comprising leveling the brace on the anchor bolts prior to vertically mounting the support member to the anchor bolts.

8. The method of claim 7, comprising leveling the brace on the anchor bolts with threaded bearings mounted on the protruding ends of the anchor bolts.

9. The method of claim 1, comprising arranging an upper surface of the brace flush with or slightly below the surface of the ground.

* * * * *